United States Patent [19]

Sayles

[11] Patent Number: 4,925,504

[45] Date of Patent: May 15, 1990

[54] AMBIENT CURE CATALYST FOR SOLID PROPELLANTS

[75] Inventor: David C. Sayles, Huntsville, Ala.

[73] Assignee: The United States of America as represented by the Secretary of the Army, Washington, D.C.

[21] Appl. No.: 450,755

[22] Filed: Dec. 14, 1989

[51] Int. Cl.[5] ..... C06B 45/02

[52] U.S. Cl. ..... 149/21; 149/2; 149/19.4; 149/19.9; 149/42; 149/76; 149/92; 149/113

[58] Field of Search ..... 149/19.4, 19.9, 92, 149/42, 76, 2, 21, 113

[56] References Cited

U.S. PATENT DOCUMENTS

| | | | |
|---|---|---|---|
| 3,967,989 | 7/1976 | Hawthorne | 149/19.2 |
| 4,001,058 | 1/1977 | Hawthorne | 149/22 |
| 4,131,499 | 12/1978 | Flanigan | 149/92 |
| 4,412,874 | 12/1983 | Huskins et al. | 149/19.9 |
| 4,429,634 | 2/1984 | Byrd et al. | 149/19.9 |
| 4,597,811 | 7/1986 | Ducote | 149/19.92 |
| 4,803,019 | 2/1989 | Graham et al. | 149/19.9 |

*Primary Examiner*—Stephen J. Lechert, Jr.
*Attorney, Agent, or Firm*—Freddie M. Bush; James T. Deaton

[57] ABSTRACT

A fast-acting cure catalyst for use in hydroxyl-terminated polybutadiene-based solid propellant formulation is tris(ethoxyphenyl)bismuthine. The incorporation of this catalyst as an additive in an amount of about 0.025 weight percent into a composite propellant formulation enables the formulation to be ambient mixed and ambient cured at 80° F. or accelerated oven cured at 140° F. Both oven and ambient cures are considerably more cost effective than the conventional oven cure if the prior art cure catalyst, triphenylbismuthine (TPB), is used. Other composite propellant ingredients comprise ammonium perchlorate of about 65 weight percent, aluminum powder of about 14 weight percent, the organic oxidizer, cyclotetramethylenetetranitramine, of about 10 weight percent, isophorone diisocyanate additive to provide an isocyanate/hydroxyl ratio of about 0.92, and hydroxyl-terminated polybutadiene polymer of about 11.5 weight percent.

2 Claims, No Drawings

AMBIENT CURE CATALYST FOR SOLID PROPELLANTS

DEDICATORY CLAUSE

The invention described herein may be manufactured, used, and licensed by or for the Government for governmental purposes without the payment to me of any royalties thereon.

BACKGROUND OF THE INVENTION

The need for compounds for use in propellant compositions to prevent catalysis of the urethane reaction by cure inducing materials such as Catocene, iron oxide, ferric fluoride, etc. without interfering with the function of the cure catalyst triphenylbismuthine was met with the employment of about 0.02 to about 0.03 weight percent of dicarboxylic acids (e.g. maleic and oxalic or anhydrides of the same). Extended potlife in diisocyanate cured polymer systems, such as hydroxyl-terminated polybutadienes, polyesters, etc. is achieved with typical potlife changes being increased from 0–2 hours to 12–15 hours. The use of triphenylbismuthine (TPB) promotes the urethane reaction as well; therefore, the use of the dicarboxylic acid provides other advantages which enables TPB to be used even with the more reactive isocyanates since potlife is extended and undesirable side reactions are reduced as well. A commonly assigned U.S. Pat. No. 4,597,811, titled: "Prevention of Unwanted Cure Catalysis in Isocyanate Cured Binders", which was issued to Marjorie E. Ducote on July 1, 1986, provides additional teachings of cure catalysis behavior of TPB and the dicarboxylic acids, including the discovery of the additional benefits achieved from premixing the catalyst system with the diisocyanate curing agent before they are added to the propellant slurry. This behavior was evidenced in the use of maleic anhydride (MAN) particularly where maleic acid (MAC) is present as a contaminant in the MAN and where MAC is produced by hydrolysis of MAN.

SUMMARY OF THE INVENTION

The benefit of a fast-acting cure catalyst for use in hydroxyl-terminated polybutadiene-based solid propellant formulation which can be derived by polymerization at ambient temperature (80° F.) cure or by accelerated oven (140° F.) cure are readily recognized. This benefit is achieved by the use from about 0.015 to about 0.025 weight percent additive of tris(ethoxyphenyl)bismuthine (TEPB) in place of triphenylbismuthine (TPB). The compound tris(ethoxyphenyl)bismuthine is synthesized by the reaction of ethoxyphenylmagnesium bromide with bismuth trichloride.

The evaluation of TEPB included comparing the characteristics and mechanical properties derived from its use in an ambient mixed and cured propellant with a high temperature-cured propellant composition using TPB as the cure catalyst additive. The results indicate that the ambient cure process is viable and produces a propellant having adequate mechanical properties. The control and experimental propellant employed the same propellant ingredients in the amounts set forth under Table I below.

DESCRIPTION OF THE PREFERRED EMBODIMENT

Tris(ethoxyphenyl)bismuthine is used in a hydroxyl-terminated polybutadiene-based solid propellant formulation at ambient mixing and curing at 80° F. and in accelerated oven cure at 140° F. This use is very cost effective while meeting or exceeding the 30% thermal strain and 40% cold ignition strain values and also having acceptable processibility. Table I below depicts the propellant formulation used to evaluate the high temperature curing with TPB and the ambient mixing and curing with TEPB.

TABLE I

Evaluation of the Ambient Mixed and Cured Propellant with the High Temperature-Cured Propellant

| Composition/ Characteristics | HIGH-TEMPERATURE CURED PROPELLANT* (Wt %) | AMBIENT MIXED AND CURED PROPELLANT** (Wt %) |
|---|---|---|
| Composition | | |
| Ammonium perchlorate (%) (400-micrometers) | 29.5 | 29.5 |
| Ammonium perchlorate (%) (200-micrometers) | 30.0 | 30.0 |
| Ammonium perchlorate (%) (20-micrometers) | 5.0 | 5.0 |
| Aluminum Powder (%) | 14.0 | 14.0 |
| HMX*** (%) (4-micrometers) | 10.0 | 10.0 |
| Hydroxyl-terminated polybutadiene polymer (%) | 11.5 | 11.5 |
| Isophorone diisocyanate Isocyanate/hydroxyl ratio | 0.89 | 0.92 |
| Characteristics | | |
| End-of-mix Viscosity | | |
| 4 hrs (KP) | 8.7 | 11.1 |
| 8 hrs (KP) | 25.7 | |
| Shore A Hardness | 40 | |
| Burning Rate ($r_{1000}$) (ips) (cured) | 0.26 | 0.28 |
| Burning Rate ($r_{1000}$) (ips) (cured) | 0.25 | 0.27 |
| Pressure Exponent | 0.30 | 0.30 |
| Mechanical Properties (2 ipm) (77° F.) | | |
| Tensile Strength (psi) | 56 | 94 |
| Strain @ Max Stress (%) | 26 | 42 |
| Modulus (psi) | 262 | 400 |

*Contains Triphenylbismuthine 0.025 weight percent
**Contains Tris(ethoxyphenyl)bismuthine 0.025 weight percent additive.
***HMX is cyclotetramethylenetetranitramine, an organic oxidizer.

A series of pint mixes were also made in which the stoichiometry of the ingredients were varied. This showed that an ambient cure process is viable, and the process produces a propellant having adequate mechanical properties.

The evaluations above show that the mechanical properties and characteristics meet or exceed the values for an acceptable propellant formulation during processing and after curing.

Both oven and ambient cures for the TEPB propellant were found to be more cost effective than the TPB propellant employing conventional oven cure. In addition, cost calculations on propellant manufacture which compared the conventional oven cure with the accelerated oven cure and the ambient cure reveal that the ambient cure was the most cost effective.

A comparison of the effect of triphenylbismuthine and tris(ethoxyphenyl)bismuthine assuming the production of 100 booster motors for an advanced exoatmospheric interceptor is presented in TABLE II. These calculations effectively prove that a major cost savings can be achieved through the use of tris(ethoxyphenyl)- bismmuthine instead of tripheylbismuthine, and additionally, a marked shortening of the process time is achieved.

TABLE II (Cost Comparison of Effect of Propellant Cure Catalysts Assuming 100 Booster Motors Manufacture for an Advanced Exoatmospheric Interceptor)

| | Conventional* Oven Cure | Accelerated** Oven Cure | Ambient** Oven Cure |
|---|---|---|---|
| Processing Time (days) (total) | 9 | 5 | 7 |
| Potlife (hours) | 20 | 8 | 20 |
| Mix time (first stage motors) (hours) | 6 | 5 | 6 |
| Mix time (second stage motors) (hours) | 12 | 10 | 12 |
| First-stage mold sets required (No.) | 30 | 20 | 24 |
| Second-stage mold sets required (No.) | 36 | 20 | 24 |
| Amortized mold sets costs/motor | $168,000 | $100,000 | $120,000 |
| Heating cost/motor | $19,800 | $12,000 | 0 |
| Pressure costs/motor | 6,600 | $4,000 | 0 |
| Chemical*** modification costs/motor | $28,000 | 0 | 0 |
| Mixing costs/motor | $182,000 | $210,000 | $182,000 |
| Total costs/motor | $404,000 | $326,000 | $302,000 |

*Contains triphenylbismuthine
**Contains tris(ethoxyphenyl)bismuthine
***Hydroxyl-terminated polybutadiene prepolymer modified by chain extension

I claim:

1. A composite propellant composition comprising:

(i) ammonium perchlorate of about 64.5 weight percent;

(ii) aluminum powder of about 14.0 weight percent;

(iii) an organic oxidizer compound of cyclotetramethylenetetranitramine of about 10.0 weight percent;

(iv) hydroxyl-terminated polybutadiene polymer of about 11.5 weight percent;

(v) isophorone diisocyanate to yield an isocyanate to hydroxyl ratio of about 0.92; and, (vi) a fast-acting cure catalyst additive of tris(ethoxyphenyl)bismuthine in an amount from about 0.015 about 0.025 weight percent, said fast-acting cure catalyst additive enabling said composite propellant composition to be ambient mixed and to bring about polymerization of said hydroxyl-terminated polybutadiene to achieve curing at an ambient temperature of about 80° F. or to achieve accelerated oven curing at about 140° F., said ambient and oven curing being more cost effective as compared with a like composite propellant composition that is cured by a conventional high temperature oven curing method which employs the conventional triphenylbismuthine as the cure catalyst.

2. The composite propellant composition as defined in claim 1 wherein said ammonium perchlorate comprises about 29.5 weight percent of 400-micrometers particle size, of about 30.0 weight percent of 200-micrometers particle size, and of about 5.0 weight percent of 20-micrometers particle size; said additive of tris(ethoxyphenyl)bismuthine is present in an amount of about 0.025 weight percent; and wherein said organic oxidizer compound of cyclotetramethylenetranitramine has average particle size of about 4-micrometers.

* * * * *